US005301470A

United States Patent [19]

Sato

[11] Patent Number: 5,301,470

[45] Date of Patent: Apr. 12, 1994

[54] BALL LAPPING MACHINE

[75] Inventor: Chuichi Sato, Fujisawa, Japan

[73] Assignee: NSK Ltd., Tokyo, Japan

[21] Appl. No.: 937,739

[22] Filed: Sep. 1, 1992

[30] Foreign Application Priority Data

Sep. 2, 1991 [JP] Japan ..... 3-248328

[51] Int. Cl.[5] ..... B24B 11/06

[52] U.S. Cl. ..... 51/109 R; 51/289 S; 51/130

[58] Field of Search ..... 51/116, 117, 111 R, 51/109 R, 289 S, 130

[56] References Cited

U.S. PATENT DOCUMENTS

| | | | |
|---|---|---|---|
| 1,418,887 | 6/1922 | Sellew | 51/116 |
| 3,924,356 | 12/1975 | Kitchel | 51/289 S |
| 3,984,945 | 10/1976 | Messerschmidt | 51/289 S |
| 4,069,621 | 1/1978 | Gheorghe et al. | 51/117 |

FOREIGN PATENT DOCUMENTS

| | | | |
|---|---|---|---|
| 0000803 | 1/1900 | Austria | 51/130 |
| 0534541 | 10/1955 | Italy | 51/289 S |
| 47-8599 | 5/1972 | Japan . | |
| 54-164189 | 11/1979 | Japan . | |
| WO88/08771 | 11/1988 | PCT Int'l Appl. . | |
| 0201981 | 8/1923 | United Kingdom | 51/130 |

*Primary Examiner*—Robert A. Rose
*Attorney, Agent, or Firm*—Shapiro and Shapiro

[57] ABSTRACT

In a ball lapping machine in which balls are machined by lapping between two lapping plates, namely a stationary plate and a turn table, the structure is arranged with a central shaft having a common center line with a sleeve rotative around the center shaft, a housing supporting the sleeve rotatively, a stationary plate on which the aforesaid central shaft is mounted, and the turn table on which the aforesaid sleeve is mounted. With such structure, the aforesaid center line is made inclinable at appropriate angles to the vertical.

8 Claims, 7 Drawing Sheets

PRIOR. ART

BALL LAPPING MACHINE

BACKGROUND OF THE INVENTION

1. Field of the Invention

The present invention relates to an improved ball lapping machine which performs ball lap machining between two lapping plates, a turn table and a stationary plate.

2. Related Background Art

The conventional ball lapping machine is such that balls are placed between the two lapping plates, rotary and stationary, for lap machining, and is structured in such a manner that only the rotary lapping plate (hereinafter referred to as turn table) is rotatively supported by a shaft while the stationary lapping plate (hereinafter referred to as stationary plate) is connected to the rod of a hydraulic cylinder. As disclosed in Japanese Utility Model Laid-Open Application No. 54-164189, for example, the structure is arranged by providing the turn table 6 and stationary plate 5 oppositely so that the center lines can be horizontal (FIG. 3). In another example, disclosed in Japanese Patent Laid-Open Application No. 47-8599, there each of the lapping plates is arranged oppositely so that the center lines can be vertical (FIG. 4).

In either case, the supply, discharge, and circulation of the balls 7 are performed by a normal method such as shown in FIG. 5.

However, in the conventional ball lapping machines shown in FIG. 3 and FIG. 4, the structures are all arranged to support the turn table 6 and stationary plate 5 from the reverse side of each of the two discs. As a result, these plates are affected by the heat generated in the rotating spindle 42 and the temperature rise of lapping liquid, thus causing the concentricity of the grooves of the respective discs to vary as well as the variation of its parallelism to take place. This creates problems in ball lap machining and reduces the machining precision which results in the degraded sphericity of the finished balls, roughness of finish and the like. Then, the machining load exerted between the discs will also produce similarly adverse effects.

Also, in the embodiment with the horizontal shaft arrangement as shown in FIG. 3, ball stocks 7 are put in the grooves 5*a* and 6*a* of both discs at the time of initial setting, but the operation is difficult due to the fine adjustment required for the provision of the space between the discs. In addition, the same difficulty is encountered when the finished balls are drawn after the lap machining is completed. On the other hand, in the embodiment with the vertical shaft arrangement as shown in FIG. 4, there is no operational difficulty such as mentioned above, but abrasive particles and the like are accumulated in the groove of the disc on the lower said to create a problem in that scratches occur on the balls being machined. There is also a problem that it is difficult to circulate the balls smoothly during the lap machining.

SUMMARY OF THE INVENTION

An object of the present invention is to provide a compactly structured ball lapping machine designed with a view to solving the problems in the conventional technique with regard to machining accuracy, operability, circulation, and other factors.

In order to achieve the above-mentioned object, a ball lapping machine in which balls are machined by lapping between two lapping plates providing a stationary plate and a turn table is structured according to the present invention with a central shaft having a common center line with a sleeve which is rotative around the central shaft, and a housing which supports the sleeve rotatively. The machine is characterized in that the stationary plate is mounted on the aforesaid central shaft and the turn table is mounted on the aforesaid sleeve, with the axial center of the aforesaid housing being allowed to incline at an appropriate angle to the vertical.

With the above-mentioned structure, the center line of the central shaft is placed substantially vertical when the ball stocks are set. At this juncture, the groove between both discs which receives the ball stocks becomes horizontal. Consequently, the ball stocks can be set smoothly and rapidly. Then, when the ball stocks thus set are machined, the above-mentioned center line is inclined. At this juncture, the sleeve attached to the turn table is rotated. Since the center lines are common and the support portions for both discs are placed on the same one side of each of the discs, the concentricity and parallelism of the grooves of both discs are not caused to vary. Hence, the ball stocks are machined in a desirable sphericity and mirror-like finish. Moreover, the generated abrasive particles and machining waste are not accumulated in the groove of the disc on the lower side but are dropped down from the space between both discs. Thus, there is no possibility that the surfaces of the balls being machined are scratched. The circulation of the balls also is not hindered.

DETAILED DESCRIPTION OF THE PREFERRED EMBODIMENTS

Hereinafter, with reference to the accompanying drawings, the detailed description will be made of preferred embodiments according to the present invention. In this respect, the same reference numbers are adopted for the constituents in common with the conventional example.

Figure 1:
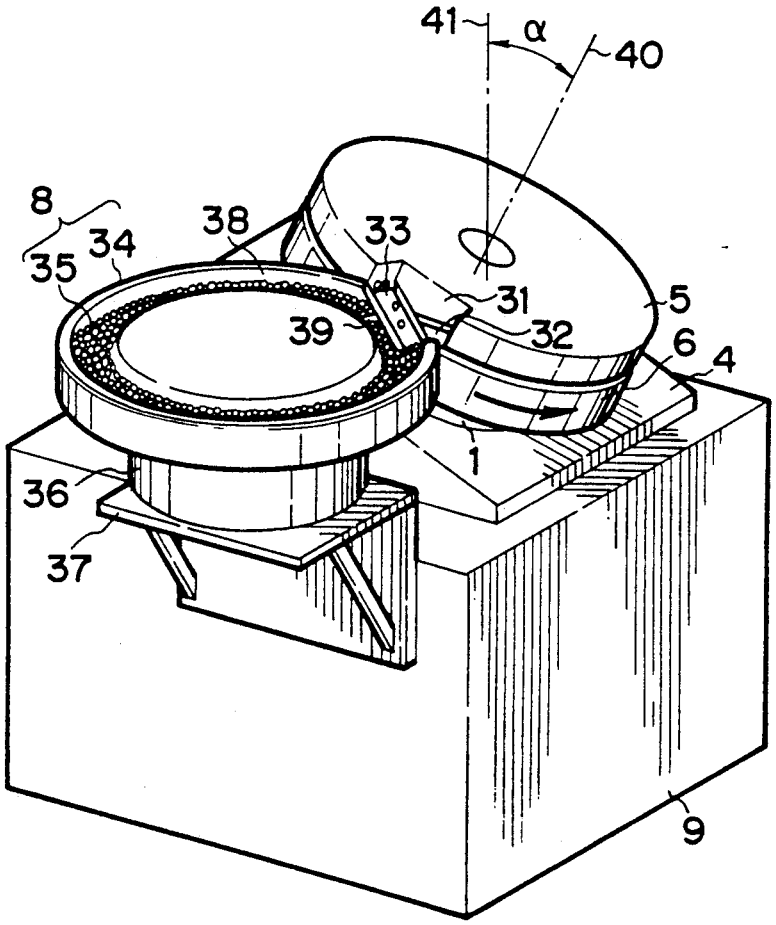
FIG. 1 is a perspective view showing a ball lapping machine according to the present invention.
Figure 2:
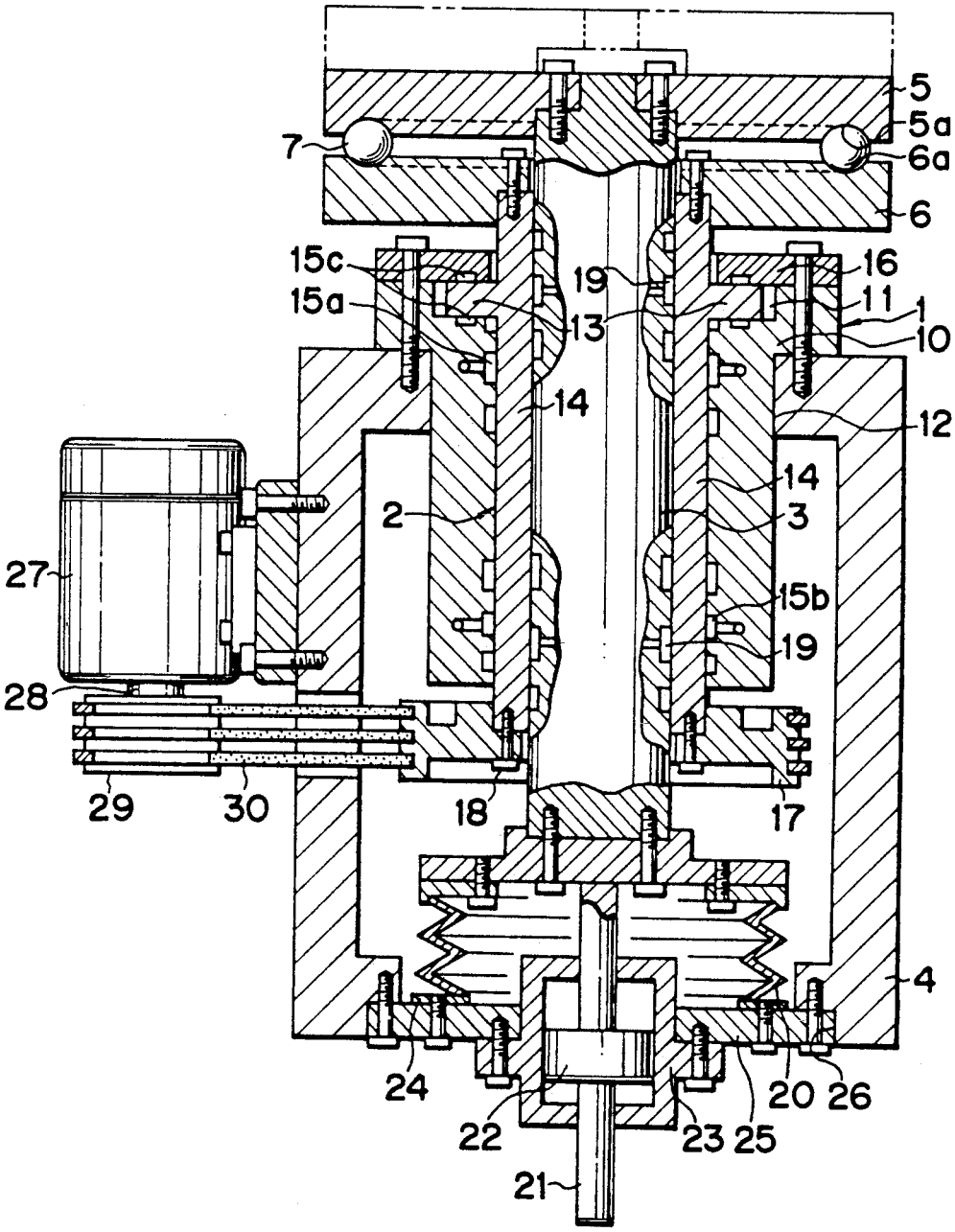
FIG. 2 is a vertically sectional view showing the principal part of the ball lapping machine shown in FIG. 1.
Figure 3:
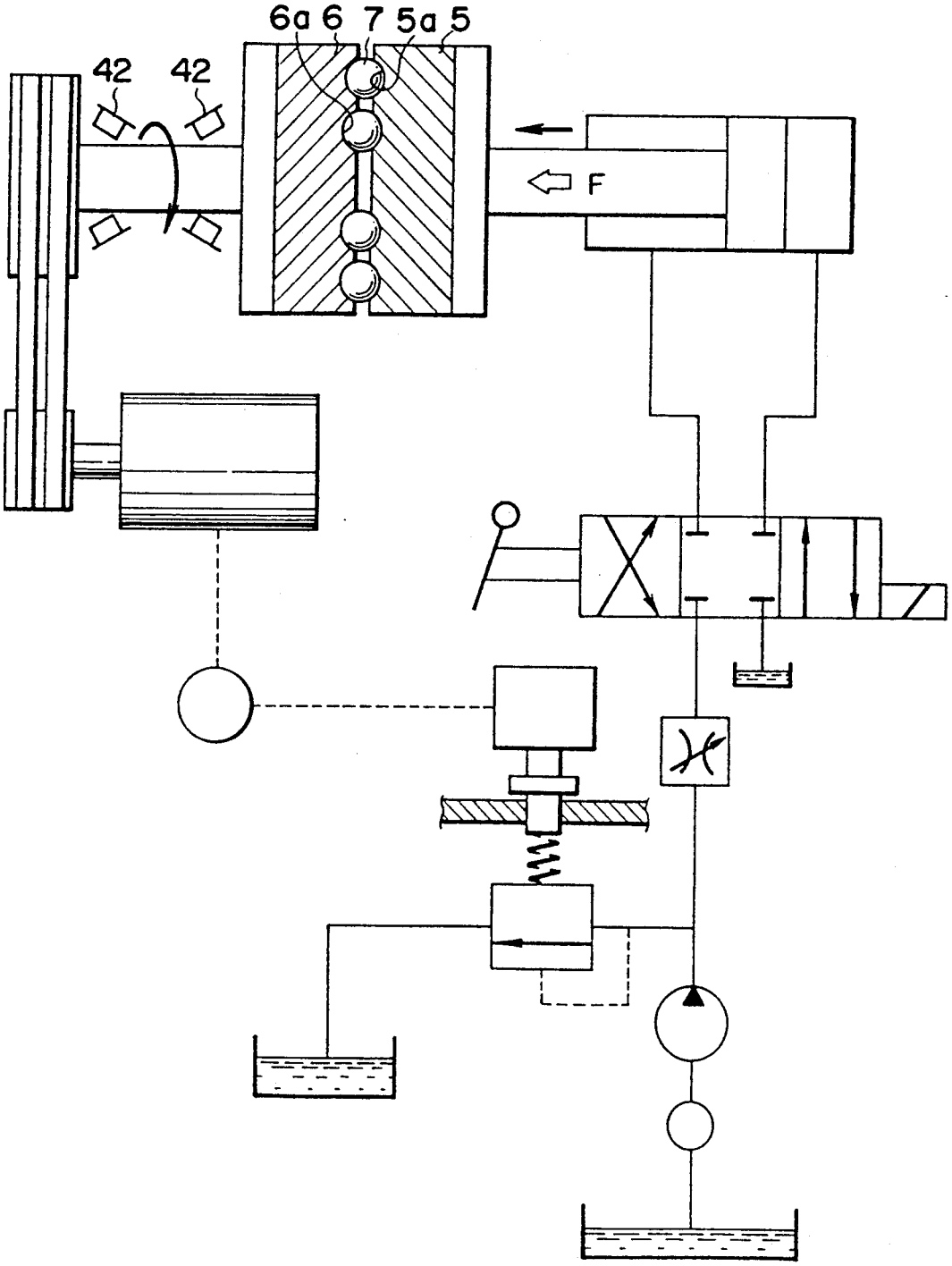
FIG. 3 PRIOR ART
FIG. 3 is a view schematically showing a conventional lapping machine.
Figure 4:
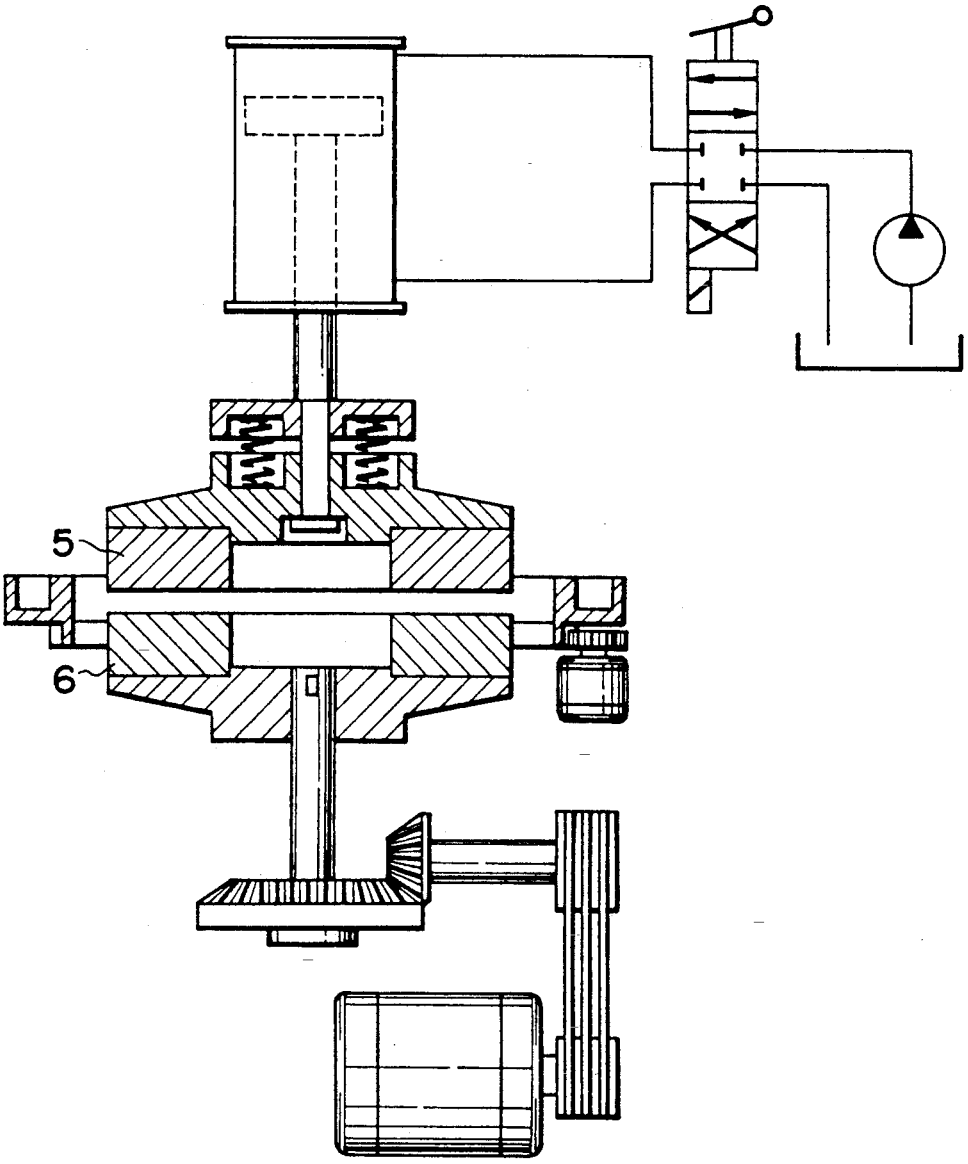
FIG. 4 PRIOR ART
FIG. 4 is a view schematically showing another conventional lapping machine.
Figure 5:
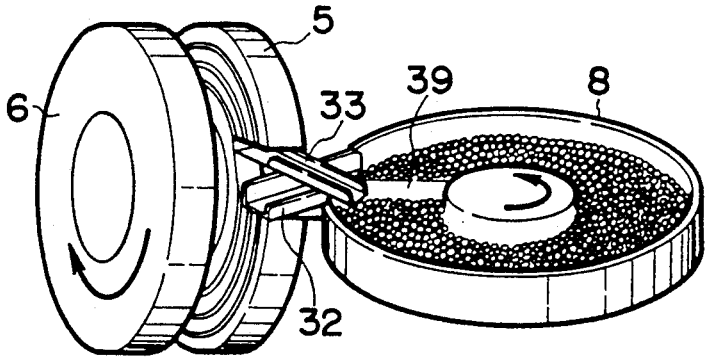
FIG. 5 is a perspective view showing the state of connection between the ball lapping machine shown in FIG. 3 and a conveyer.

FIG. 1 is a perspective view showing a ball lapping machine according to the present invention. FIG. 2 is a vertically sectional view showing the unit main body which constitutes the principal part of the ball lapping machine shown in FIG. 1. In FIGS. 1 and 2, a reference numeral 1 designates a housing; 2, a; 3, a central shaft; 4, the unit main body; 5, a stationary plate; 6 a turn table; 7, a ball; 8, a conveyer; and 9, a base.

The housing 1 is a box-like member formed with a flange 10 mounted on the outer periphery of its upper end and an annular cut off 11 on the inner periphery of its upper end, respectively. The aforesaid flange 10 portion is fitted into the upper aperture edge 12 of the main body 4 of a barrel type unit and fixed by screws, etc. Also, to the aforesaid cut off 11, a flange 13 projected from the outer periphery of the upper portion of the sleeve 2 is fitted.

The sleeve 2 is a cylinder comprising a barrel 14 formed with the aforesaid flange 13 formed on the outer periphery of the upper portion of the barrel 14. The barrel 14 is rotatively supported in the aforesaid housing 1 through hydrostatic (thrust) bearings 15*a* and 15*b* and at the same time, the aforesaid flange 13 portion is rotatively fitted into the aforesaid cut off 11 to regulate its movement in the axial direction through a hydrostatic thrust bearing 15*c*. A reference numeral 16 designates a movement regulation lid fixed to the aforesaid flange 10 by screws or some other fixing means.

The upper end of the aforesaid barrel 14 is fitted into the lower end of the turn table 6 and the lower end of the barrel, into the upper end of a pulley 17, and the ends are fixed respectively by fixing means 18 such as screws. The aforesaid central shaft 3 is rotatively supported in relation to the barrel 14 by a hydrostatic (thrust) bearing 19 arranged on the outer periphery of the central shaft 3.

The central shaft 3 is arranged through the aforesaid barrel 14, and at the upper end and lower end thereof, the stationary plate 5 and, a diaphragm 20 are mounted respectively to maintain its stationary state against the rotation of the aforesaid barrel 14, that is, of the sleeve 2.

With the axial line at the center of the aforesaid diaphragm 20, a piston rod 21 is extended concentrically, and a cylinder 23 accommodating a piston 22 of the piston rod 21 is fixed to the lower aperture edge 26 of the main body 4 of the aforesaid unit through a lid 25 together with the lower frame 24 of the diaphragm 20. By means of the aforesaid cylinder 23, the stationary plate 5 is vertically movable. Thus, the load exerted by machining the ball stocks 7 can be applied to the lower side of the stationary plate.

On the external side of the main body 4 of the unit, a driving motor 27 is mounted. To the output shaft 28 of the driving motor, a pulley 29 is mounted and a belt 30 is tensioned around the pulley 29 and a pulley 17 on the aforesaid sleeve side. Hence, the aforesaid sleeve 2 and turn table 6 are driven to rotate.

On the opposite faces of the stationary plate 5 and turn table 6, grooves 5*a* and 6*a* are provided with the curvatures matching with the objective sphere of the surface finish of the ball stocks 7. These grooves 5*a* and 6*a* are formed to be annular having the same diameter, the center of which is shared by the stationary plate 5 and turn table 6, respectively. In the present embodiment, they constitute one annular groove. However, it may be possible to provide a plurality of annular grooves having different diameters.

On the outer peripheral edge of the stationary plate 5, a cut off portion 31 is formed to cut off annular groove 5*a* to serve dually as a ball set and withdrawal.

In the cut off portion 31, the leading end of an entrance chute 32 connected from upstream of an annular conveyer 8 faces the groove 6*a* on the downstream side in the rotational direction of the turn table 6. On the other hand, in the aforesaid cut off portion 31, the leading end of an exit chute 33 directed downstream of the aforesaid conveyer 8 faces the groove on the upstream side in the rotational direction of the turn table 6.

The conveyer 8 comprises a annular frame 34, a main body 35 of the conveyer incorporated in the aforesaid annular frame 34, and a motor 36 for driving the conveyer main body 35. On the base 9, the aforesaid conveyer main body 35 is mounted so as to be maintained substantially horizontal. Here, a reference numeral 37 designates an installation bracket. In the annular frame 34, there are provided as shown in FIG. 1 the portion where the leading end of the exit chute 33 faces and a partition board 39 for separating a connecting inlet 38 connected to the entrance chute 32.

On the aforesaid base 9, the unit main body 4, on which the housing 1, sleeve 2, central shaft 3 and others are mounted, is installed as shown in FIG. 1 with the angle $\alpha$ between the center line 40 and vertical line 41 being adjustable.

Subsequently, the description will be made of the operation of an embodiment having a structure such as described above.

When a given amount of the ball stocks 7 is supplied to the conveyer 8, the angle $\alpha$ shown in FIG. 1 is firstly adjusted to be small at the time of setting the ball stocks 7. At this juncture, the turn table 6 and stationary plate 5 show an angle of inclination with a slight slope which is close to the horizontal; thus making it easier to supply 5 the ball stocks 7 to the groove 6*a* of the cut off portion 31 from the conveyer 8 through the entrance chute 32. At the same time, when the piston 22 is driven upward as shown in FIG. 2, the central shaft is shifted upward against the biasing force exerted by the diaphragm 20. Thus, the stationary plate 5 is shifted toward a position indicated by a chain line to make the space between the stationary plate and turn table 6 greater, facilitating further the supply of the ball stocks 7 to the grooves 5*a* and 6*a*. In this case, since the center lines 40 of the stationary plate 5 and turn table 6 are shared by both of them, there is no possibility that the concentricity of each of the grooves 5*a* and 6*a* is caused to vary. After the ball stocks 7 are supplied to the groove 6*a*, the cylinder 23 is downwardly moved so as to reduce clearances between the ball stocks and the grooves 5*a* and 6*a*, to zero.

Then, in continuity, in order to machine the supplied ball stocks 7 by lapping, the angle $\alpha$ is made large. As a result, the inclination of the turn table 6 and stationary plate 5 becomes steep. Now, by operating the driving motor 27 to cause the turn table 6 to rotate, the ball stocks 7, which are being pinched between the grooves 5*a* and 6*a*, are allowed to revolve along the grooves 5*a* and 6*a* while being rotated on their own axes, during the period of which, lapping liquid is injected to machine them by lapping. At this time, the cylinder 23 is moved downward to shift the central shaft 3 downward to press the stationary plate 5 in the direction indicated by a solid line for applying a working pressure, thereby to conduct the lap machining with a desired precision. In this case, for the same reason described above, the concentricity and parallelism of the grooves 5*a* and 6*a* will not vary, and the abrasive particles and others are not accumulated in the grooves 5*a* and 6*a* and are easily dropped downward, hence enabling the ball stocks 7 to be movably circulated smoothly.

Lastly, when the ball stocks 7 are withdrawn after the lap machining is completed, the angle $\alpha$ is narrowed and then the piston 22 is raised to widen the space between the stationary plate 5 and turn table 6. Thus, the finished balls are discharged onto the conveyer 8 from the exit chute 33.

According to a lap machining cycle such as this, the next ball stocks 7 of a given amount which have been conveyed to the vicinity of the entrance chute 32 by the rotation of the conveyer 8 are supplied to the ball lapping machine in the same cycle as described above. They are then machined by lapping and are discharged onto the conveyer 8. In this way, the ball stocks 7 supplied to the conveyer 8 are sequentially machined by lapping within a given period of time.

As described above, in a ball lapping machine in which the balls are machined by lapping between the two lapping plates, a stationary plate and a turn table, a structure is arranged according to the present invention with a central shaft having a common center line with a sleeve mounted rotatively around the central shaft, and a housing supporting the sleeve rotatively. Thus, the stationary plate is mounted on the aforesaid central shaft and the turn table on the aforesaid sleeve, respectively, to constitute a double shaft structure. The ball lapping machine is characterized by making the axial center of the aforesaid housing inclinable at appropriate angles to the vertical. Therefore, there is no effect caused by heat generated by the rotating spindle on the turn table side and the temperature rise of lapping liquid. The concentricity and parallelism of the grooves are not caused to vary either. As a result, the sphericity, surface roughness, dimensional precision and other machining accuracy for the finished balls are enhanced while the operability such as supply of the ball stocks and the withdrawal of the finished balls is improved. Moreover, the movable circulation of the ball stocks during the lap machining becomes smooth. It is also possible to prevent scratches from occuring on the surfaces of the finished balls due to the accumulation of abrasive particles and the like.

Now with reference to FIG. 6 and FIG. 7, the description will be made of another embodiment according to the present invention.

Figure 6:
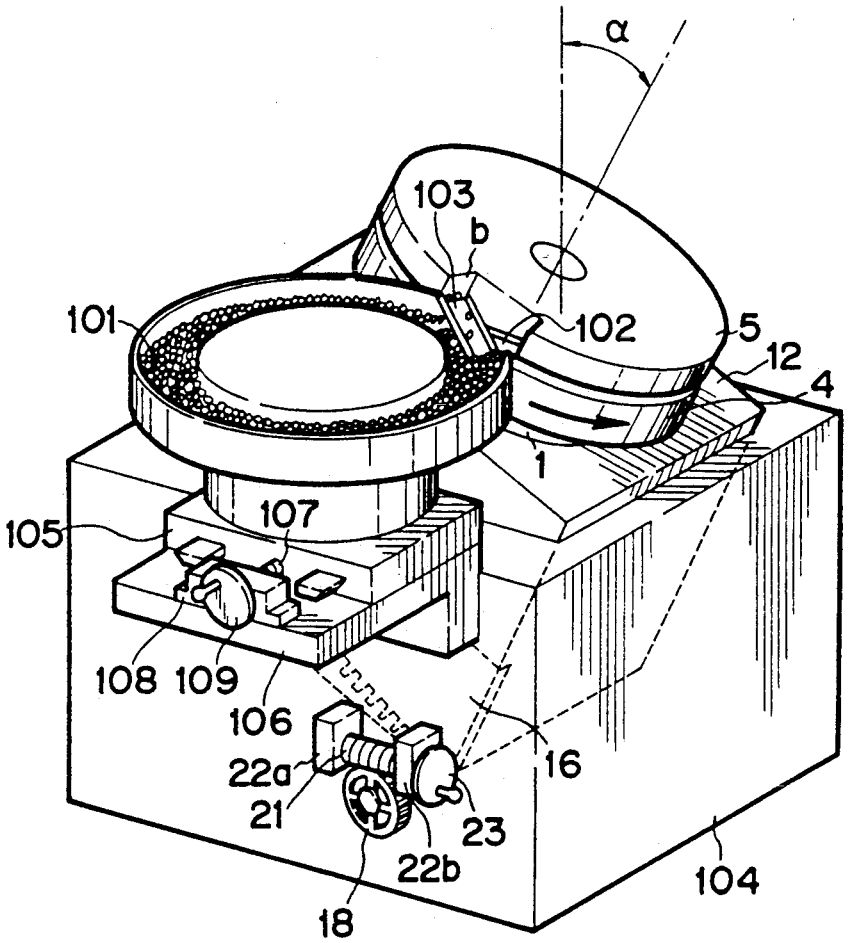
FIG. 6 and FIG. 7 are views showing another embodiment of ball lapping machine according to the present invention.

In FIG. 6, a conveyer 101 is mounted on a slider 105. The slider 105 is mounted on an installation member 106 and held by the guide of a dovetail and others and is movable forward and backward by a handle 109, a thread 107, and a supporting base 108. With this structure, the conveyer 101 can be drawn to the front side together with chutes 102 and 103 with each rotation of the handle 109 when the inclination of a unit 12 is changed from the illustrative position to the vertical in FIG. 6.

Figure 7:
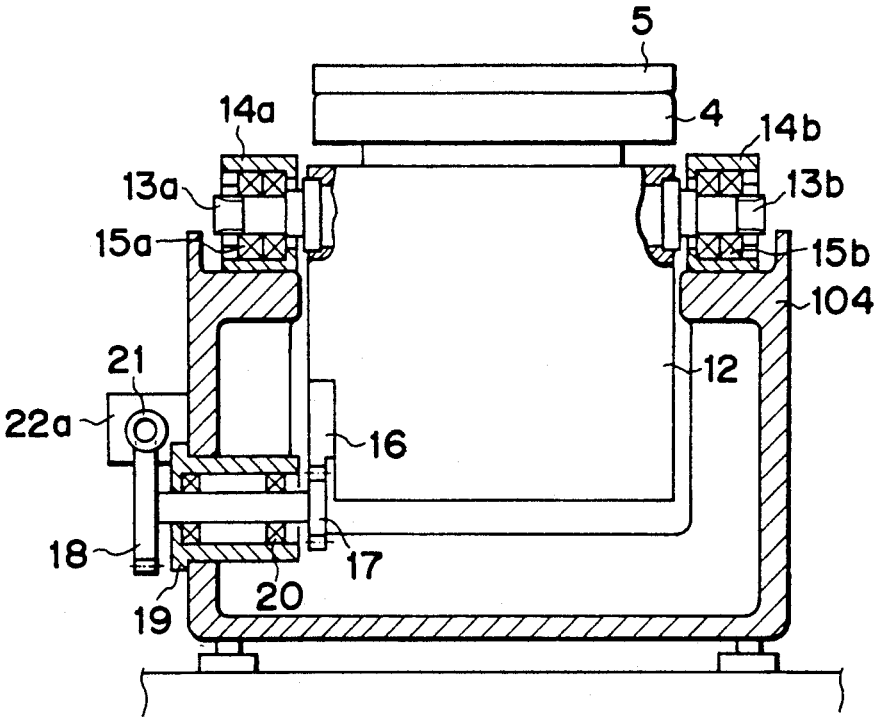

In FIG. 6 and FIG. 7, the unit 12 having shafts 13*a* and 13*b* mounted thereon is rotatively supported by supporting bases 14*a* and 14*b* as well as bearings 15*a* and 15*b*, and is mounted on a base 104. Further, to the unit 12, a partial gear 16 is mounted in such a manner that its center and the central axes of the shafts 13*a* and 13*b* are matched. This partial gear 16 is in a state to engage with a gear 17 which is mounted on a shaft rotatively supported by a supporting base 19 and bearings 20. Thus, when a worm wheel 18 which is mounted on the other end of the shaft and a worm 21 which is supported by supporting bases 22*a* and 22*b* are rotated by means of the handle 23, the partial gear causes a unit 12 to be inclined with respect to the shafts 13*a* and 13*b* with the central axes of the shafts 13*a* and 13*b* as its center.

In this respect, the representation of those parts related to the conveyer 101 is omitted in FIG. 7.

What is claimed is:

1. A ball lapping machine in which balls are machined by lapping between tow lapping plates providing a stationary plate and a turn table, comprising a shaft, a sleeve coaxial with and rotative around said shaft, and a housing having means supporting said sleeve rotatively, the ball lapping machine being characterized in that the stationary plate is mounted on said shaft and the turn table is mounted on said sleeve, and that means are provided for changing inclination of an axis of said housing relative to vertical.

2. A ball lapping machine according to claim 1, further characterized int hat means are provided for effecting axial displacement of said shaft relative to said sleeve to effect relative displacement of said stationary plate and said turn table.

3. A ball lapping machine, comprising a stationary plate supported on a shaft, a turn table opposing said stationary plate and supported on a sleeve disposed about said shaft, said sleeve and said shaft having a common axis, means for supplying balls to a space between said stationary plate and said turn table, means for rotating said sleeve about said shaft to rotate said trunk able relative to said stationary plate, and means for adjusting the inclination of said axis.

4. A ball lapping machine according to claim 3, wherein said space is defined by opposed grooves of said stationary plate and said turn table.

5. A ball lapping machine according to claim 4, further comprising means for receiving balls from said space.

6. A ball lapping machine according to claim 5, wherein said supplying means includes a first chute disposed to supply balls to said space defined by said grooves when said axis is substantially vertical, and said receiving means includes a second chute disposed to receive balls from said space defined by said grooves when said axis is substantially inclined relative to vertical.

7. A ball lapping machine according to claim 6, wherein said chutes cooperate with a cut-out region of said stationary plate and said turn table at which ends of said grooves are exposed.

8. A ball lapping machine according to claim 3, further comprising means for effecting axial displacement of said shaft relative to said sleeve to effect relative displacement of said stationary plate and said turn table.

* * * * *